US006238234B1

(12) United States Patent
Sedlecky

(10) Patent No.: US 6,238,234 B1
(45) Date of Patent: May 29, 2001

(54) TERMINAL BLOCK WITH REDUCED DIELECTRIC MATERIAL

(75) Inventor: Daniel P. Sedlecky, Naperville, IL (US)

(73) Assignee: Marconi Communications, Inc., Cleveland, OH (US)

( * ) Notice: Subject to any disclaimer, the term of this patent is extended or adjusted under 35 U.S.C. 154(b) by 0 days.

(21) Appl. No.: 09/514,071

(22) Filed: Feb. 26, 2000

(51) Int. Cl.[7] ..... H01R 4/24
(52) U.S. Cl. ..... 439/412; 439/709; 439/936
(58) Field of Search ..... 439/411–414, 709, 439/521; 29/855, 848, 871, 936

(56) References Cited

U.S. PATENT DOCUMENTS

| | | | |
|---|---|---|---|
| 4,600,261 | 7/1986 | Debbaut | 439/521 |
| 4,634,207 | 1/1987 | Debbaut | 439/521 |
| 4,864,725 | 9/1989 | Debbaut | 29/871 |
| 4,993,966 | 2/1991 | Levy | 439/411 |
| 5,140,746 | 8/1992 | Debbaut | 28/855 |
| 5,149,278 | 9/1992 | Waas et al. | 439/412 |
| 5,357,057 | 10/1994 | Debbaut | 174/84 |
| 5,639,992 | 6/1997 | Debbaut | 174/84 |
| 6,074,240 * | 6/2000 | Bradshaw et al. | 439/412 |

* cited by examiner

*Primary Examiner*—Hien Vu
(74) *Attorney, Agent, or Firm*—Jones, Day, Reavis & Pogue

(57) ABSTRACT

A terminal block for distributing telecommunication signals, the block including a base, an outer housing, internal contacts, actuators and threaded bolts, the actuators engaging and disengaging feed wires with and from the contacts. The interior space occupied by the contacts, bolts and actuators is divided into front and back chambers and protective dielectric gel is injected but cured only in the front chambers. During movement of the actuators less dielectric material is extruded out of the block and thus electrical integrity of the block is enhanced.

4 Claims, 5 Drawing Sheets

TERMINAL BLOCK WITH REDUCED DIELECTRIC MATERIAL

BACKGROUND OF THE INVENTION

1. Field of the Invention

The present invention relates to terminal blocks, such as those used to connect a multiconductor telecommunications cable to drop wires feeding a local telephone distribution, and more particularly to such terminal blocks having dielectric material used to insulate the interior electrical contacts and mechanisms from adverse ambient conditions such as dirt and grime.

2. Description of the Related Art

In a application owned by the assignee of the present application Ser. No. 08/948,973 entitled Terminal Block, filed Oct. 10, 1997, and now U.S. Pat. No. 6,070,240 the structure of a terminal block is described in great detail. The description in that application is incorporated herein by reference.

As disclosed in the above-identified application, a cavity formed between an upper housing and a base where electrically conductive contacts and actuator mechanisms are located, is filled with a viscous dielectric material. The dielectric material, in the form of a gel, cures at the site to protect the mechanisms and the contacts from ambient or environmental conditions. For example, the terminal block may be located in an outdoor cabinet exposed to climatic conditions. Encasing or potting the conductive contacts and mechanisms in a dielectric material insulates these items from inclement weather, moisture, dirt and other undesirable elements which might interfere with the electrical connection between the contacts and the distribution feed wires.

In operation of the terminal block, the actuator mechanism is moved upwardly and downwardly when feed wires are engaged with or disengaged from the electrical contacts. However, during movement of the actuators, some of the gel is displaced through openings in the terminal block. When this happens, tools being used by the technician to operate the actuators may stick to the dielectric material and may cause some of the gel to be pulled away from the terminal block thereby degrading the protection offered by the material. Also, the material, if a gel, responds like a rubber band to movement. It biases whatever was moved back to its original position even though this may be undesirable. Further, the dielectric material is expensive, both in product and labor if it must be replaced. Also, dielectric material extruded out of the terminal block may pick up grime from the outer surface of the block. If the material is then pulled back into the block as usually happens, the adhering grime may also be pulled into the block and may interfere with the electrical functioning of the contacts.

BRIEF SUMMARY OF THE INVENTION

The difficulties encountered with existing systems have been overcome by the present invention. What is described here is a terminal block adapted to connect to an electrical cable comprising a base, an electrically conductive contact mounted to the base, an actuator slidably mounted to the contact and movable from a lowered position wherein an electrical conductor may be retained in physical engagement with the conductive contact to a raised position wherein the electrical conductor, such as a feed wire, may be engaged with or disengaged from the electrically conductive contact, the actuator having a front wall, a rearwardly extending support wall connected to the front wall, a threaded portion connected to the rearwardly extending support wall, and an intermediate partition wall connected to the support wall, the intermediate partition wall having front and rear surfaces, a threaded bolt engaging the threaded portion of the actuator for moving the actuator between the lowered and the raised positions, an outer housing for engaging the base and for partially covering the electrically conductive contact, the actuator and the threaded bolt, the outer housing having a top wall, a back wall connected to the top wall, a front wall connected to the top wall and lateral interior chamber forming walls extending between the front and the back walls, the lateral interior walls cooperating with the partition wall of the actuator for forming first and second chambers between the base and the outer housing, the first chamber having disposed therein the front wall, the rearwardly extending support wall and the front surface of the intermediate partition wall of the actuator and the conductive contact, and the second chamber having disposed therein the threaded portion of the actuator and the threaded bolt, and a dielectric material positioned in the first chamber and cured therein when said actuator is in the lowered position for forming an environmental barrier about the electrically conductive contact.

The invention also includes a method for limiting the amount of dielectric material used in the terminal block comprising the steps of inverting the outer housing so that the top wall is lowermost and the interior is exposed, injecting the dielectric material into the interior, inserting the actuator, bolt and contact into the interior, rotating the outer housing about 90 degrees so that the front wall is lowermost, and curing the dielectric material in the interior.

An object of the present invention is to provide a terminal block which uses less dielectric material and therefore saves money and yet enhances protection of the internal mechanisms and the conductive contacts of the terminal block. Another object of the present invention is to provide a terminal block having a dielectric material where exposure of the dielectric material outside the terminal block is reduced. A further aspect of the present invention is to provide a terminal block having a dielectric material where the effect of the dielectric material on the operation of the internal mechanisms of the terminal block is minimized. Another aim of the present invention is to provide a dielectric containing terminal block which reduces the contact of the dielectric material with tools used to operate the mechanism in the terminal block when engaging or disengaging electrical feed wires. Yet another advantage of the present invention is to provide a method for limiting the amount of dielectric material used in a terminal block, the method being inexpensive, effective and reliable.

A more complete understanding of the present invention and other objects, aspects, aims and advantages thereof will be gained from a consideration of the following description of the preferred embodiment read in conjunction with the accompanying drawings provided herein.

DETAILED DESCRIPTION OF THE INVENTION

Figure 1:
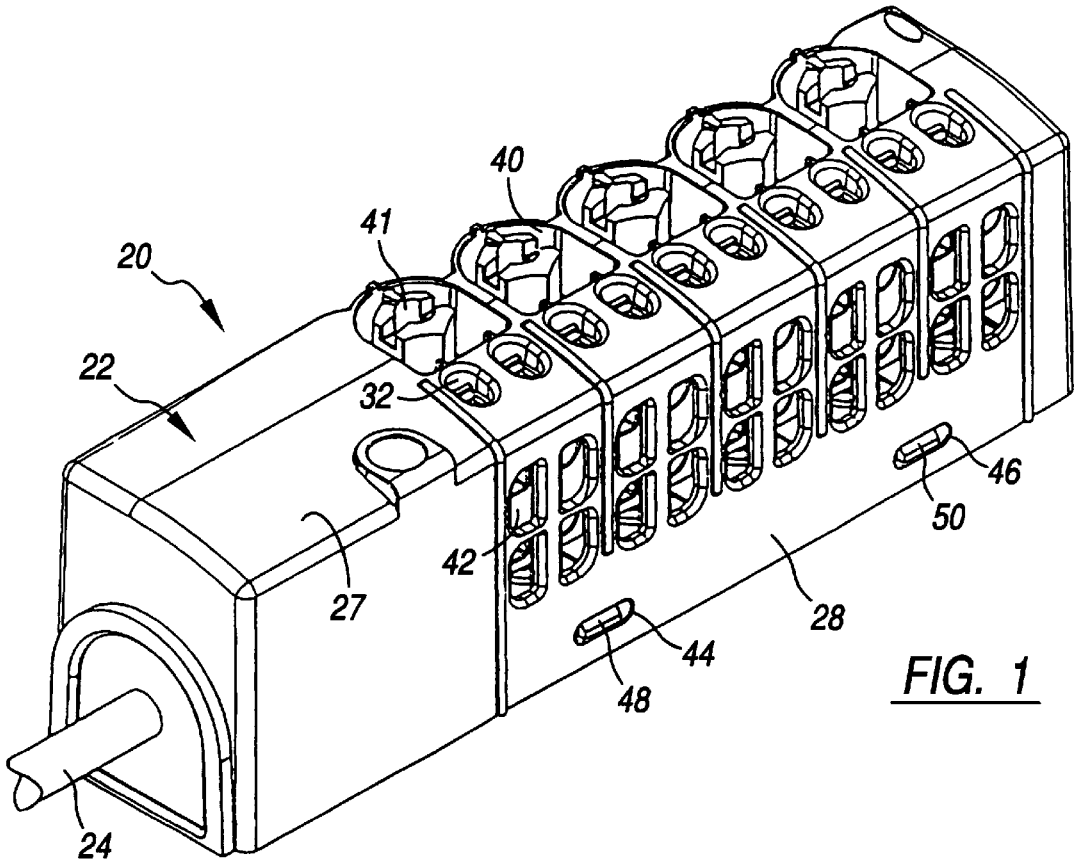
FIG. 1 is a front perspective view of a terminal block of the present invention.

While the present invention is open to various modifications and alternative constructions, the preferred embodiment shown in the drawings will be described herein in detail. It is understood, however, that there is no intention to limit the invention to the particular form disclosed. On the contrary, the intention is to cover all modifications, equivalent structures and methods and alternative constructions falling within the spirit and scope of the invention as expressed in the appended claims.

Figure 2:
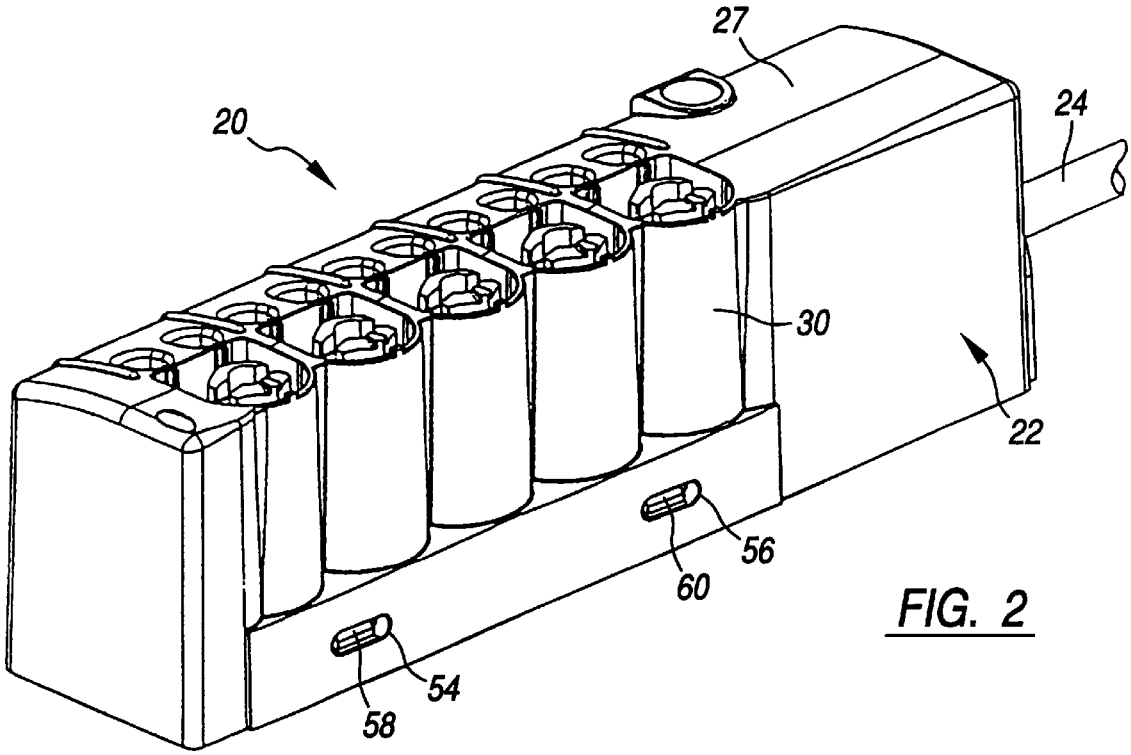
FIG. 2 is a rear perspective view of the terminal block of FIG. 1.
Figure 3:
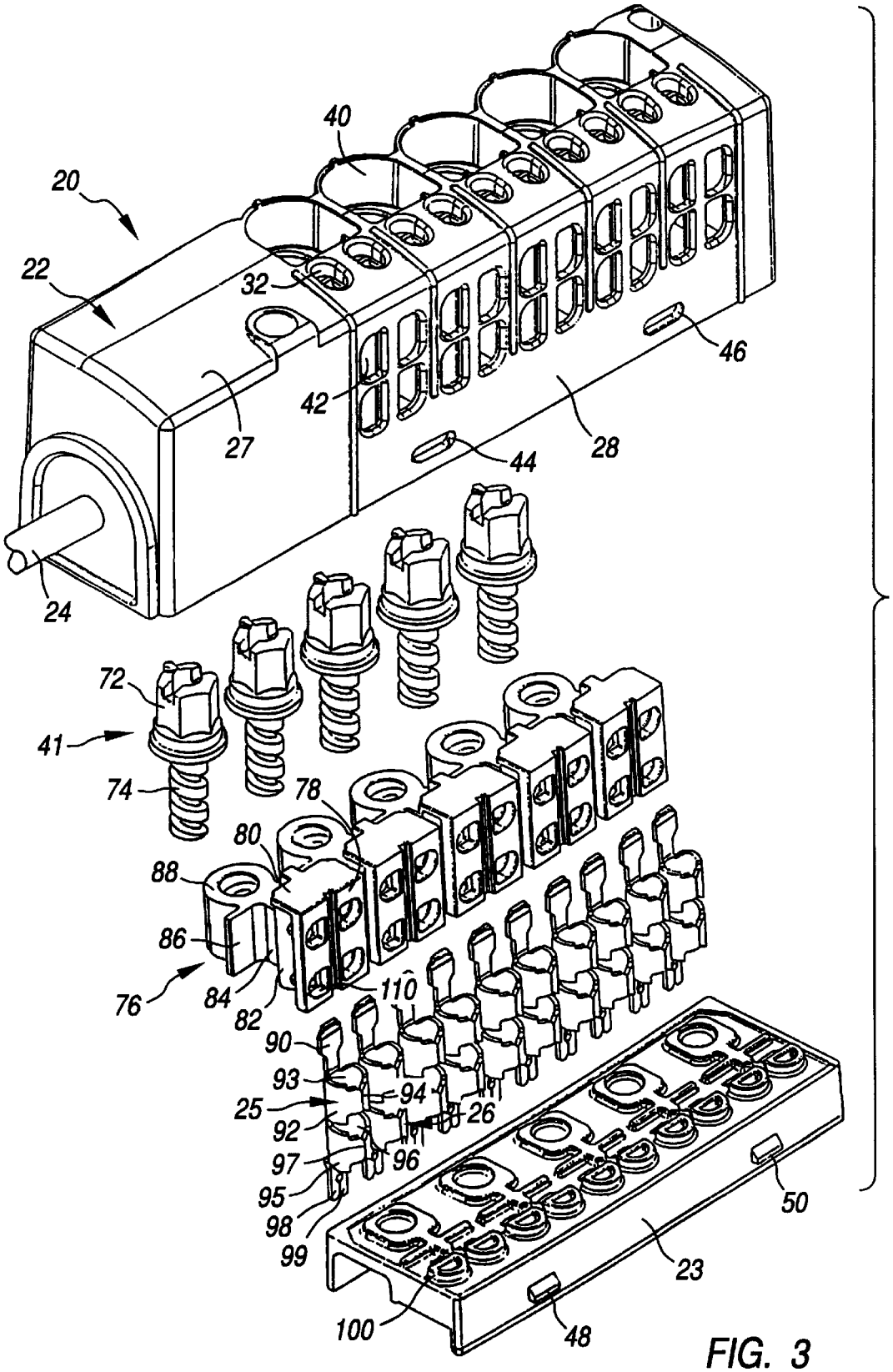
FIG. 3 is a exploded front perspective view of the terminal block of FIGS. 1 and 2 illustrating the internal actuators, threaded bolts and electrically conductive contacts.
Figure 4:
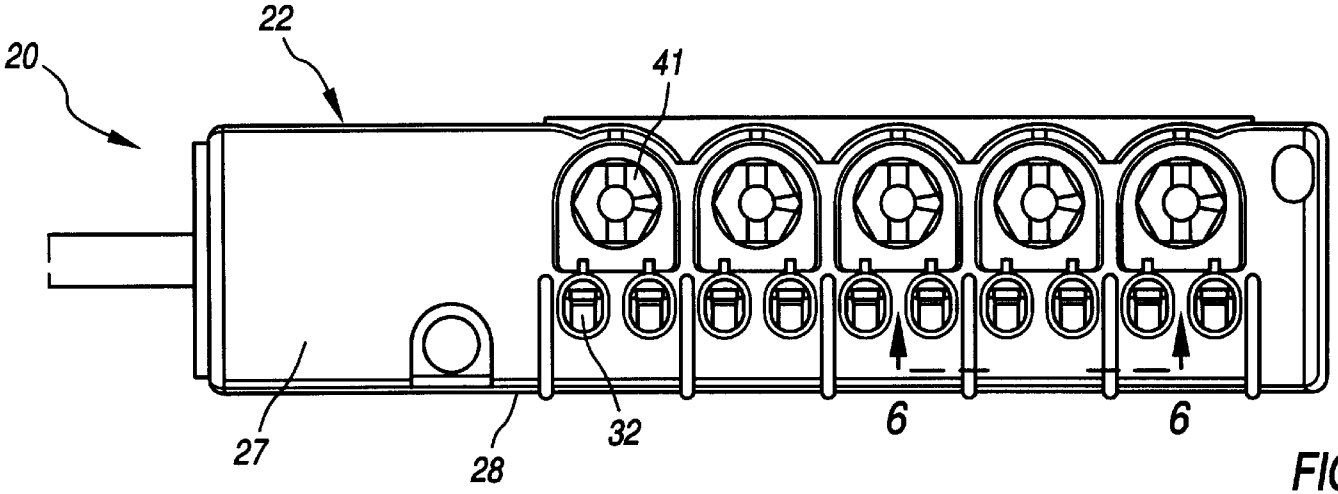
FIG. 4 is a top plan view of the terminal block of FIGS. 1–3.
Figure 5:
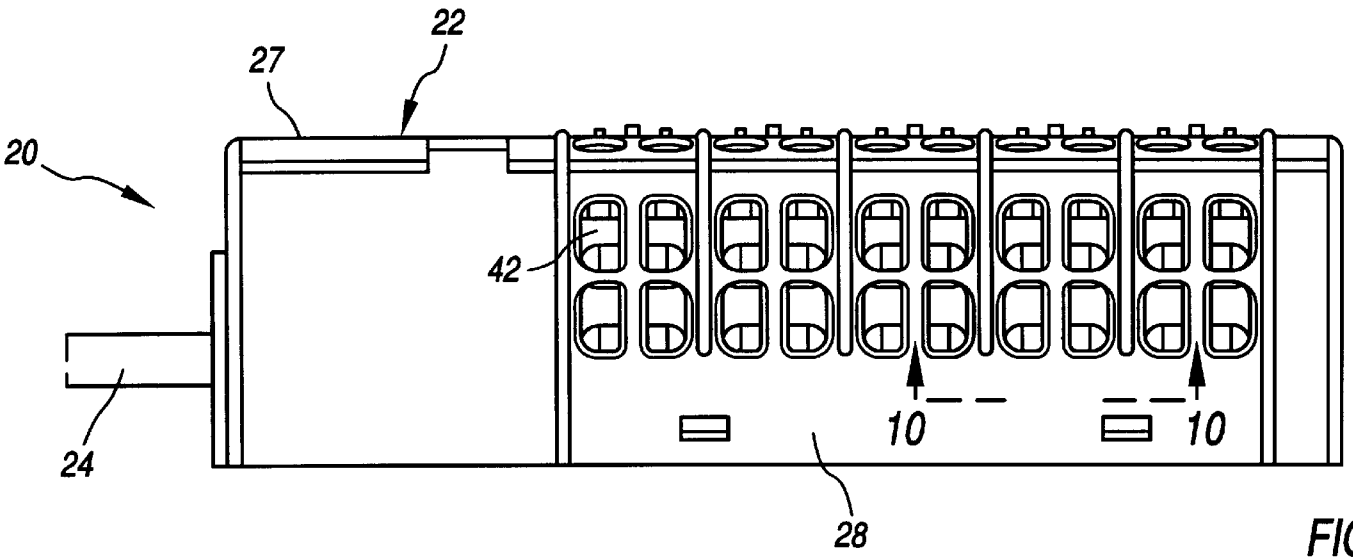
FIG. 5 is a front elevational view of the terminal block of FIGS. 1–3.

Referring now to FIGS. 1–3, there is illustrated a terminal block 20 having an outer housing 22, a base 23 and an electrical cable 24. The cable contains a plurality of electrical conductors which will engage various electrically conductive contacts mounted within the terminal block. A plurality of electrically conductive contacts such as the contacts 25 and 26 are mounted to the base 23 through appropriate openings in the base. The outer housing 22 includes a top wall 27, a front wall 28 and a back wall 30. The top wall has a series of contact test ports such as the test port 32. The top wall also includes a series of recessed openings, such as the opening 40, for receiving threaded bolts such as the bolt 41. The front wall 28 includes a series of wire openings, such as the wire opening 42, for receiving electrical conductors, such as feed wires, designed to engage the electrically conductive contacts mounted to the base.

The outer housing 22 also includes two pairs of snap openings, such as the front openings 44 and 46, which will engage corresponding snap tabs 48 and 50 of the base 23. The rear wall 30 also includes a pair of snap openings 54 and 56 which engage snap tabs 58 and 60 of the base. The mechanism within the terminal block includes the contacts, a plurality of actuators, and a plurality of threaded bolts. The bolt 41 has a head portion 72 and a threaded stem portion 74. Each bolt engages and operates an actuator, such as the actuator 76. The actuator 76 includes a front wall 78, a top wall 80, two posts, such as the post 82, a rearwardly extending support wall 84, an intermediate partition wall 86 and a threaded portion connected to the support wall in the form of a threaded sleeve 88.

Each electrically conductive contact has a head portion 90, two upper looped arms 92, 93 separated by a slot 94 and two lower looped arms 95, 96 separated by a slot 97. Each electrically conductive contact also includes a set of legs 98, 99 which are received within an opening 100 in the base 23 so as to allow the conductive contacts to be mounted to the base and extend beneath it to connect to the conductors within the cable. The actuators are formed to slide vertically along the conductive contacts when the threaded bolts are rotated. The threaded bolt 41 engages the threaded portion 88 of the actuator 76 while each post is received by the two pairs of curved arms of a contact. The front wall 78 of the actuator includes a number of openings such as the opening 110, and these are aligned to expose the slots 94, 97 of the electrically conductive contacts. The actuator allows feed wires to be engaged with conductive contacts and to be properly located in relation to the conductive contacts as will be explained below.

Figure 6:
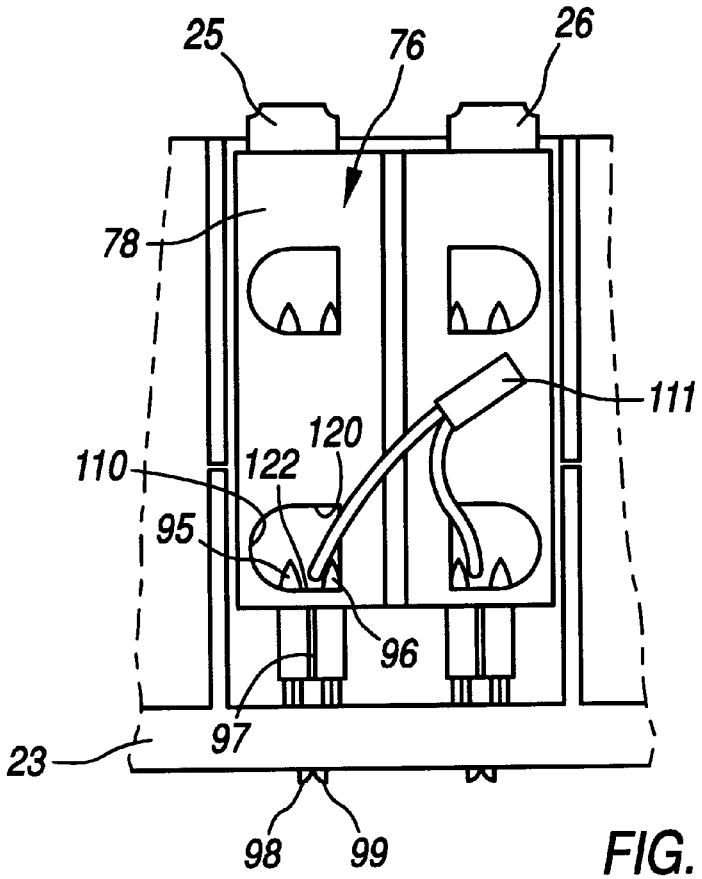
FIG. 6 is an enlarged partial front elevational view of the terminal block taken along line 6—6 of FIG. 4 showing the actuator in a raised position.
Figure 7:
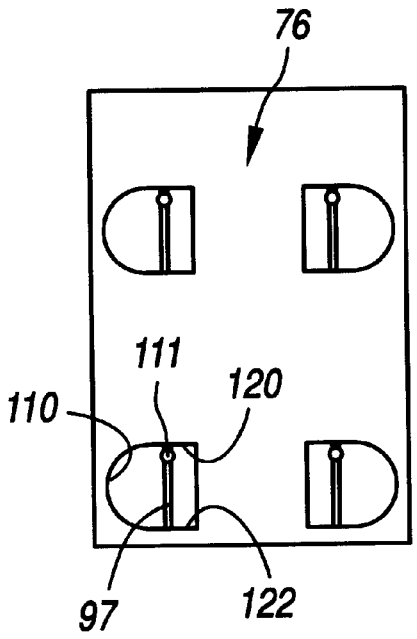
FIG. 7 is a front elevational view of the actuator of FIG. 6 in a lowered position.

Referring now to FIGS. 4, 5, 6 and 7, the operation of the actuator will be described. In FIG. 6 the actuator 76 is shown in its raised positions relative to the fixed position of the electrically conductive contacts such as the conductive contacts 25, 26. As mentioned a pair of legs 98, 99 of the contact are mounted in the base 23. The opening 110 of the front wall 78 of the actuator allows an electrical conductor or feed wire 111 to be inserted from outside the terminal blocks through the opening 42 in the outer housing and into the mouth portion of the looped arms 95 and 96. When such a wire is arranged, the actuator is brought downwardly to the lowered position shown in FIG. 7 where a top edge 120 of the opening 110 will engage the feed wire 111 and force it into the slot 97 of the conductive contact. This has the dual benefit of forcing a wire into the slot and positioning the wire correctly so as to maintain the conductive contact within a predetermined stress range. When it is desired to disengage the wire 111 from the conductive contact slot 97, the actuator 76 is moved upwardly so that a bottom edge 122 of the opening 110 engages the wire 111 and forces it upwardly in the slot to the mouth region of the contact thereby allowing the wire to be disengaged and removed. It should be understood that an insulative dielectric material such as Sealrite Self-Restoring Gel LT produced by CasChem, Inc., of Bayonne, N.J. will cover the actuator and the conductive contacts so as to protect the mechanism from ambient dirt, moisture and grime. However, it will not interfere with the engagement or disengagement of the wire from the contract.

Figure 8:
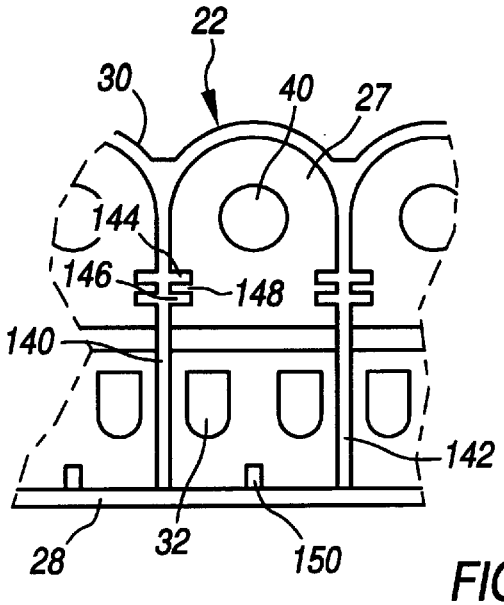
FIG. 8 is an enlarged, partially broken away, bottom plan view of an outer housing of the terminal block shown in FIGS. 1–3.
Figure 9:
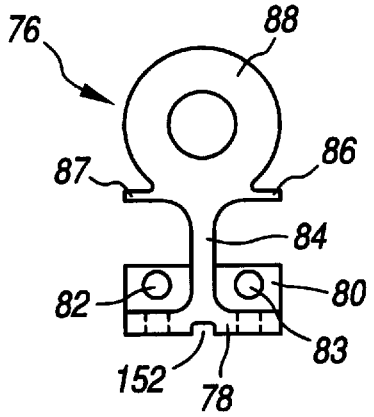
FIG. 9 is a bottom plan view of the actuator shown in FIG. 3.

Referring now to FIGS. 8 and 9, the interior of the outer housing is illustrated in more detail. As mentioned the outer housing 22 includes the top wall 27, the front wall 28 and the back wall 30. The test port 32 is provided in the top wall and the opening 40 is provided for the threaded bolt. Positioned laterally between the front wall 28 and the back wall 30 are two interior chamber forming walls 140 and 142 which divide the terminal block into compartments or cavities, each compartment including two conductive contacts, a slidable actuator and a threaded bolt. Each interior wall includes two guide arms, such as the guide arms 144 and 146, so that a guide channel, such as the channel 148, is formed. On the inside of the front wall 28 is a guide rail 150.

The actuator 76, FIG. 9 includes the front wall 78, the top wall 80, the post 82, the support wall 84 and the threaded portion 88. In addition, the actuator includes a second post 83, the intermediate partition wall 86 extending to the right and another intermediate partition wall 87 extending to the left. It may now be appreciated that the partition walls 86 and 87 are designed to ride within guide channels such as the channel 148, FIG. 8. A slot 152 in the front wall of the actuator is designed to engage the guide rail 150 of the outer housing.

Figure 10:
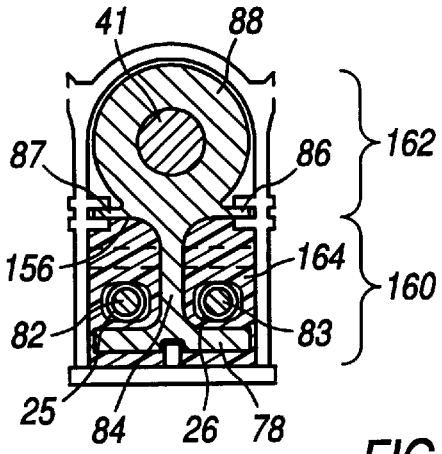
FIG. 10 is a bottom sectional plan view taken along line 10—10 of FIG. 5.

When the actuator 76 is enclosed by the outer housing 22 as shown in FIG. 10, the compartment containing the pair of contacts, the actuator and the threaded bolt is divided into a first or front chamber 160 and a second or back chamber 162. In the terminal block described at the beginning of this application, dielectric material is placed within the entire compartment or cavity which is comprised of the front chamber 160 and the back chamber 162. What is proposed here is that only the front chamber receives the dielectric material 164. The front chamber contains the actuator front wall 78, the actuator support wall 84, the actuator posts 82, 83 and an inner surface 156 of the partition walls 86, 87. In addition, the two electrically conductive contacts 25 and 26 are also in the first chamber. The remainder of the actuator, primarily the threaded portions 88 and the threaded bolt 41 are situated in the back chamber 162. It has been found that the back chamber does not need dielectric material so that approximately one-third of the dielectric material is saved because from a volume standpoint the front chamber 160 occupies about two-thirds of the compartment whereas the back chamber 162 occupies about one-third.

A number of advantages are achieved in addition to the use of less dielectric material. By eliminating or greatly reducing the dielectric material around the threaded bolt there is no drag created by the dielectric material upon rotation of the bolt, nor is there a rubber band-like biasing force which might reverse rotate the bolt so as to move the actuator to its lowered position once a technician releases the tool he/she is using. Also with a smaller amount of dielectric material being used in the terminal block, there will be less material to be extruded out of the terminal block when the actuator is moved from its lowered position to its raised position since there is physically less dielectric material in the block to begin with. Yet another advantage is that when upward movement of the actuator does take place, there is room for the dielectric material to extrude around the partition walls 86, 87 either above them or below them so that the dielectric material stays within the confines of the terminal block.

The method of loading a dielectric material gel into the terminal block includes the steps of placing the outer housing in an inverted position as shown in FIG. 8, and injecting the gel which initially is in a syrupy or viscous liquid state. After injection of the gel, the base containing the internal mechanisms including the actuators and the threaded bolts as well as the conductive contacts are inserted into the outer housing and then the entire terminal block is rotated 90 degrees so as to rest on the front wall of the outer housing. This allows the viscous gel to flow into the front chamber and then cure. After approximately 30 to 60 minutes, the terminal block may be handled and moved and after approximately 24 hours, the gel is fully cured.

In operation, the actuators in the terminal block are usually in their lowered positions. When it is desired to connect a feed wire to one of the electrically conductive contacts, the technician uses a torqueing tool such as a wrench to rotate the threaded bolt in a counterclockwise direction causing the actuator to move to its raised positions. The feed wires may then be inserted through the openings in the front wall of the outer housing and the front wall of the actuator so as to position the feed wire above a slot of one of the contacts. The threaded bolt is then rotated in a clockwise direction causing the actuator to return to its lowered position and thereby move the feed wire into proper engagement with the slot of the conductive contact. To remove an electrical conductor, the process is reversed. It is at this time when the actuator is in a raised position that gel may be extruded from the block. During movement of the actuator from its lowered position to its raised position, cured gel will be pushed around but because there is less volume of gel than previously used, less of the material will be extruded through the openings of the upper housing. Also, some of the gel will be pushed into the back chamber and thus will not leave the confines of the terminal block at all. Since the gel has already cured, it is resilient and stretchable. Hence, after insertion or engagement of the feed wire, which occurs by moving the actuator from its raised position to its lowered position, gel extruded out of the front chamber will be pulled back into the position it originally had.

By not extruding the dielectric material outside of the terminal block or by keeping such extrusions to a minimum, dirt and other undesirable debris that may be adhering to the outer surface of the terminal block will not be pulled back into the terminal block when the actuator is returned to its lowered position. This improves the likelihood that electrical integrity of the connections between the feed wires and the conductive contacts is maintained.

The specification describes in detail an embodiment of the present invention. Other modifications and variations will, under the doctrine of equivalents, come within the scope of the appended claims. For example, changing the shape and size of the actuator and/or the conductive contacts are considered equivalent structures. Also, changing the shape and opening sizes of the outer housing or of the actuator are also considered to be equivalent structures. Further, the number of contacts and actuators may be increased or decreased from the ten and five, respectively illustrated in the drawing. For example, it is quite common to have twenty contacts and ten actuators in commercial versions of the terminal blocks. Still other alternatives will also be equivalent as will many new technologies. There is no desire or intention here to limit in any way the application of the doctrine of equivalents.

What is claimed is:

1. A terminal block adapted to connect to a cable and having at least one electrical conductor comprising:

a base;

an actuator slidably mounted to said conductivc contact and movable from a lowered position wherein an electrical conductor may be retained in physical engagement with said conductive contact to a raised position wherein an electrical conductor may be engaged with or disengaged from said conductive contact;

said actuator having a front wall, a rearwardly extending support wall connected to said front wall, a threaded portion connected to said rearwardly extending support wall, and an intermediate partition wall connected to said support wall, said intermediate partition wall having front and rear surfaces;

a threaded bolt engaging said threaded portion of said actuator for moving said actuator between said lowered and said raised positions;

an outer housing for engaging said base and for partially covering said conductive contact, said actuator and said threaded bolt, said outer housing having a top wall, a back wall connected to said top wall, a front wall connected to said top wall and lateral interior chamber forming walls extending between said front and said back walls which divide the terminal block into compartments, said lateral interior walls having guide arms defining a guide channel to receive said partition wall of said actuator for forming front and back chambers between said front and back walls of said outer housing, said front chamber having disposed therein said actuator front wall, said actuator rearwardly extending support wall and said front surface of said actuator intermediated separation wall and said conductive contact, and said back chamber having disposed therein said actuator threaded portion and said threaded bolt; and a dielectric material gel positioned only in said front chamber and cured therein when said actuator is in said lowered position for forming an environmental barrier about said conductive contact.

2. An apparatus as claimed in claim 1 wherein:

said back chamber includes a curved back wall.

3. An apparatus as claimed in claim 1 including:

a plurality of conductive contacts mounted to said base;

a plurality of actuators, each actuator having a front wall, a rearwardly extending support wall, a threaded portion and an intermediate partition wall; and each of said actuators engage two of said conductive contacts.

4. A method for limiting the amount of dielectric material gel used in a terminal block comprising the steps of:

providing an outer housing for a terminal block, said housing having a top wall, a front wall, a back wall, and lateral walls extending between said front and back walls which divide the terminal block into compartments, said lateral walls having guide arms defining guide channels to receive partition walls of movable actuators for forming front and back chambers between said front and back walls of said outer housing;

providing an injectable and curable dielectric material gel;

inverting said outer housing wherein said top wall is lowermost and said interior is exposed;

injecting said dielectric material gel only into said front chamber;

providing a base to which is mounted an internal mechanism including said actuator, a threaded bolt and a conductive contact;

mounting said actuator and, said bolt into said back chamber and mounting said contact into said front chamber;

attaching said base and said outer housing;

rotating said outer housing and base about 90 degrees wherein said front wall is lowermost; and curing said dielectric material gel.

* * * * *